United States Patent [19]

Hurtado

[11] Patent Number: 4,762,350

[45] Date of Patent: Aug. 9, 1988

[54] CROSS BAR LOCKING DEVICE

[76] Inventor: Otto Hurtado, 2139 N. Milwaukee Ave., Chicago, Ill. 60647

[21] Appl. No.: 107,106

[22] Filed: Oct. 13, 1987

[51] Int. Cl.[4] ..... E05C 17/54

[52] U.S. Cl. ..... 292/259 R; 340/546

[58] Field of Search ..... 292/144, 259, 260; 70/432, 417, 441; 340/546, 545

[56] References Cited

U.S. PATENT DOCUMENTS

| | | | |
|---|---|---|---|
| 3,425,742 | 2/1969 | Rauber, Jr. | 292/144 X |
| 3,821,884 | 7/1974 | Walsh | 292/259 X |
| 3,933,382 | 1/1976 | Counts et al. | 292/144 |
| 4,282,518 | 8/1981 | Bonner | 340/546 X |
| 4,319,228 | 3/1982 | Daniels | 340/546 X |
| 4,321,591 | 3/1982 | Vieweg | 340/546 X |
| 4,349,223 | 9/1982 | Spector | 292/259 R |

FOREIGN PATENT DOCUMENTS

| | | | |
|---|---|---|---|
| 9502 | of 1905 | United Kingdom | 292/259 |

*Primary Examiner*—Richard E. Moore

*Attorney, Agent, or Firm*—Robert S. Beiser

[57] ABSTRACT

A modular electric door lock for securing a door, includes a tubular housing selectively affixed to the door. A pair of brackets are positioned on either side of the door frame and fixedly attached thereto in alignment with the tubular housing. A pair of oppositely disposed slides are contained within the housing and are adapted for telescopic extension from the housing into the brackets, or for retraction therefrom. An electric motor contained within the housing extends the slide members into telescopic engagement with the brackets or retracts them as desired. The electric motors may be battery operated or operated off of 110 volt household current. A switching mechanism, which includes a timer is used for selectively locking the door. An alarm is provided for preventing auauthorized entry.

20 Claims, 2 Drawing Sheets

CROSS BAR LOCKING DEVICE

BACKGROUND OF THE INVENTION

This invention relates generally to door locking devices and more particularly to crossbar type door locking devices.

It is well known that conventional door locks may not positively prevent an intruder from breaking into and entering a home. Many of these locks can be quickly unlocked by simply sliding a fairly stiff, thin plastic card between the door and door jamb, so as to slide the bolt out of the jamb and back into the lock. Others using a dead bolt may still be unlocked by a burglar who is skilled in lock picking. Still other unauthorized entry may be made by simply giving the door a sharp kick by a foot, so that the bolt holding fitting mounted in the door jamb will split the wood of the jamb and will be pushed out from the jamb. Even the use of long mounting screws for this fitting cannot prevent such break-in if the door jamb wood is weakend by becoming rotted or dried out so as to easily split.

A number of device have been devised to overcome this problem. For example, U.S. Pat. No. 3,792,885 describes a double bar lock having oppositely extending locking bars that are mechanically extended or retracted by means of a mechanical latch. U.S. Pat. No. 4,176,347 describes a dead bolt device having an alarm attached thereto. U.S. Pat. No. 4,349,223 describes a sliding bolt for sliding across the inner side of a door of a home in which a two directional electric motor moves the bolt through U-shaped brackets mounted on the rear of the door and also on the wall adjacent each side of the door. U.S. Pat. No. 2,070,803 describes a safe having a door locking mechanism including an electric motor for moving two locking bars into engagement with the walls of the safe so as to lock it until such time as the electric motor is actuated.

The above listed devices, however, do not solve the problem of having a light, inexpensive, easily removable door locking mechanism which may be selectively attached to the door and operated manually, by an electric timer; or from a remote location.

SUMMARY OF THE INVENTION

It is thus an object of the present invention to provide a door device which is light, transportable and easily removable from a door, but which also provides a secure crossbar to prevent forcible entry.

It is a further object of the present invention to provide such a locking device which is both manually and electrically actuated.

It is an additional object of the present invention to provide such a crossbar device which includes an alarm system for indicating forcible entry and a timer for opening the door at selected intervals.

Accordingly, the present invention is a modular electric door lock for securing household doors. The lock includes a tubular housing which is easily attachable to or removable from the door. A pair of brackets is secured to either side of the door, either on the door frame or on the walls. The brackets are horizontally aligned with the tubular housing. A pair of oppositely disposed slide members are contained within the housing. The slide members are designed to telescope out from the housing into the brackets so as to bar the door or to retract back into the housing as desired. An electric motor contained within the housing is operatively connected too to the slides so as to, when actuated, telescope the slides out of the housing into the brackets or retract them.

One of the principle advantages of the present invention is the simplified electrical circuitry for providing electrical current to the electric motor. Because of the light weight of the slides, either a battery or a AC source of current may be utilized for actuating the electric motor to move the slides for opening or closing the door. The electrical system also provides current to a motion detector which actuates an alarm when forcible entry is attempted through the door. A timer is also provided for opening and closing the door lock at selected intervals.

DETAILED DESCRIPTION OF THE PREFERRED EMBODIMENT

Figure 1:
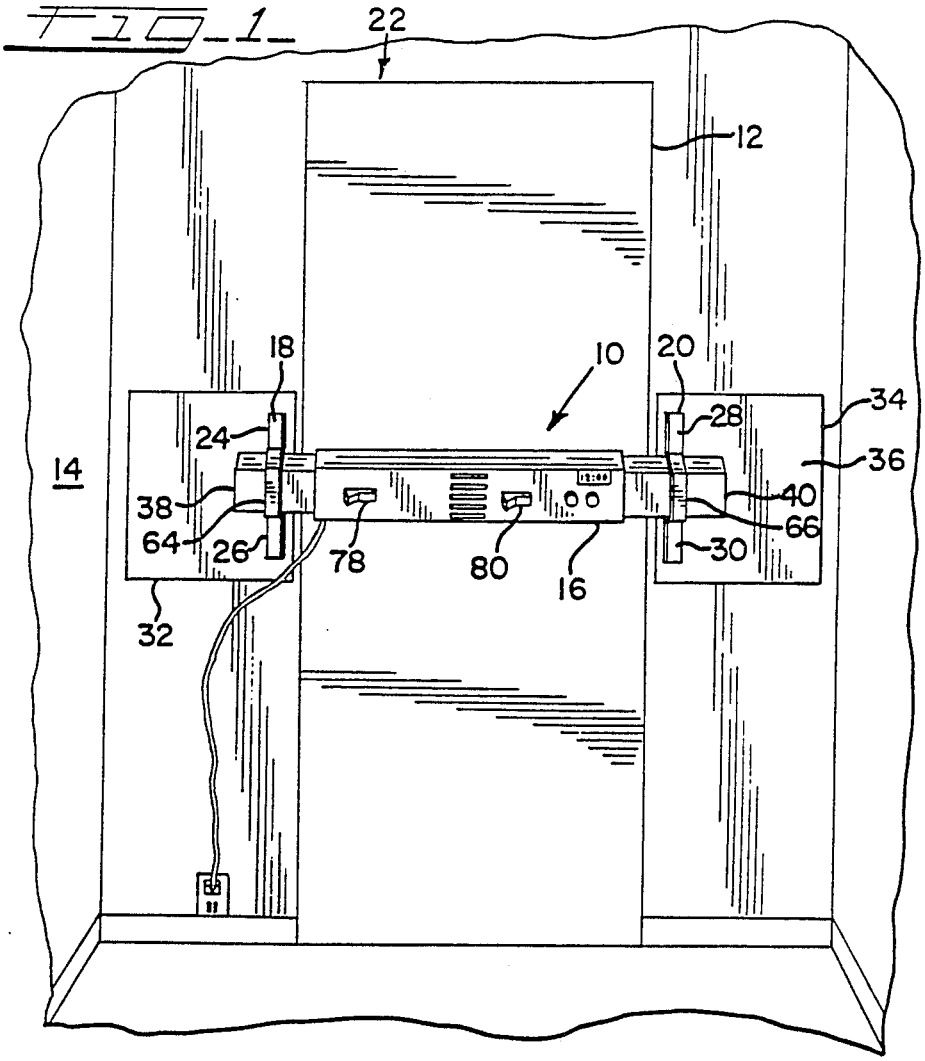
FIG. 1 is a front perspective view of the modular electric door lock of the present invention.

Referring now to the drawings, and in particular to FIG. 1, the modular electric door lock constructed in accordance with the present invention is indicated generally at 10. Modular electric door lock 10 is used for securing door 12 against unauthorized entry. Door 12 generally is a conventional inward opening door to a room 14.

The central component of modular electric door lock 10 is a tubular housing member 16, selectively affixable to door 12. Tubular housing 16 may be attached to door 12 by means of lug bolts, two-sided adhesive tape, or a variety of quick disconnect brackets as will be described herein. A pair of oppositely disposed substantially C-shaped brackets 18 and 20 are affixed on either side of door 12, to the structure 22 supporting the door. Door support structure 22 may either be the walls surrounding the door or a conventional door frame or jamb. It is preferred that brackets 18 and 20 be affixed to door support structure 22 by lug nuts 24, 26, 28 and 30 which are affixed directly to door support structure 22 or to mounting plates 32 and 34. Brackets 18 and 20 are generally horizontally disposed and are aligned with the longitudinal axis 36 of tubular housing 16. A pair of oppositely disposed slides 38 and 40 extend from tubular housing 16. In the embodiment shown, slide members 38 and 40 are telescopically receivable into or extendable from tubular housing 16. However, a variety of other configurations are encompassed within the scope of the invention, so long as slides 38 and 40 extend from and retract towards housing 16. For example, brackets 18 and 20 are unnecessary when door lock 10 is affixed to the exterior of door 12. In that instance slides 38 and 40 block manual movement of door 12 until they are retracted. However, to prevent door lock 10 from simply being removed from the door, tubular housing 16 must be secured to door 12 from the inside of the door by means of lug bolts, (not shown).

Figure 2:
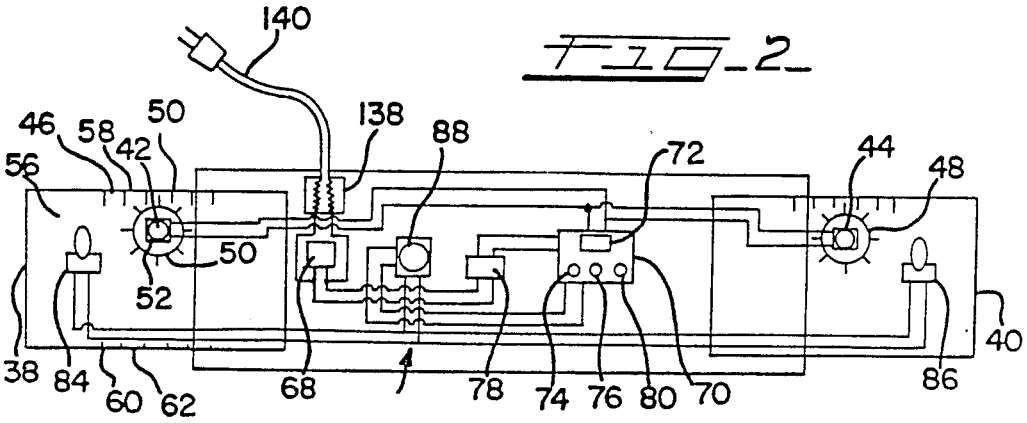
FIG. 2 of the drawings is a front cutaway view of the modular electric door lock of FIG. 1.

Turning now to FIG. 2 of the drawings, the interior of modular electric door lock 10 including the components thereof are shown. A pair of electric motors 42 and 44 are contained within housing 16 and are operatively connected to slides 38 and 40 so as to selectively extend or retract slides 38 and 40 as desired. This extension and retraction is accomplished by means of gearing mechanisms 46 and 48. Gearing mechanism 46, for example, comprises a gear wheel 50 attached to a drive shaft 52 extending from electric motor 42. Gear wheel 50 meshes with gears 54 affixed to the interior 56 of slide member 38. Thus, as electric motor 42 is actuated, shaft 52 turns gear wheel 50 which meshes with gears 46 so as to cause linear movement of slide 38. In order to reverse the direction of slide members 38 and 40, either electric motor 46 may be reversed in polarity or may be moved from a first position 58 to a second position 60 so as to interact with a second set of gears 62 thereby causing retraction of slide 38. It should also be noted that while the embodiment shown illustrates two electric motors, a single electric motor may be utilized with a conventional gearing mechanism to both slides. As further seen in FIG. 1, slide members 38 and 40, when extended, telescope into a C-shaped portions 64 and 66 of brackets 18 and 20 which are of substantially the same outside shape as slides 38 and 40 but slightly larger, so as to provide a snug but slideable fit.

As seen in FIG. 2 a system is provided for supplying electrical current to electric motors 42 and 44. In the embodiment shown a battery 68 is connected to an electric timer 70 which provides a visual indicia of the time 72, such as a conventional digital watch. Means for setting appropriate times for the electric door lock 10 to open, including switch 74 and reset button 76 are also provided. Timer 70 in turn is connected to on/off switch 78 by means of which door lock 10 may be rendered operative or inoperative as desired. Timer 70 also includes a manually operated switch 80 which may be used for selectively extending or retracting slide members 38 and 40. Timer 70 may be constructed in accordance with conventional electronic timing devices such as those disclosed in the "Electronics Engineer's Master Catalog" published by Hearst Business Communications, Inc.

An additional feature of modular electric door lock 10 is an alarm system generally designated at 82. A pair of motion detectors 84 and 86 are contained within slide members 38 and 40. Motion detectors 84 and 86 in the embodiment shown are transducers which detect physical movement of slide members 38 and 40. Transducers 84 and 86 are electrically connected to an alarm 88 which includes a horn or siren. In alternative embodiments, motion detectors 84 and 86 may be a single transducer or may comprise an electrical switch which is closed upon unauthorized movement of slide members 38 and 40 or housing 16. When door 12 is forced open or attempted to be forced open, movement against housing 16 causes transducers 84 and 86 to send an electrical signal to alarm 88, which in turn actuates alarm 88 to sound a horn, a siren, or to flash a light. The sensitivity of transducers 84 and 86 may be preset or may be adjustable through alarm 88.

Figure 6:
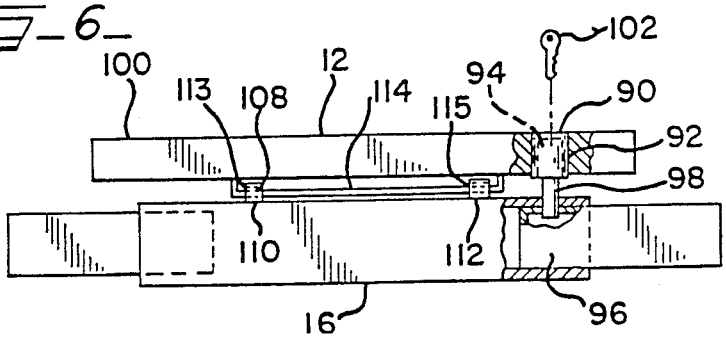
FIG. 6 is a top cutaway view of the modular electric door lock of FIG. 1.

As best seen in FIG. 6, modular electric door lock 10 includes a tumbler mechanism 90 which may be used to manually actuate electric motors 42 and 44. Tumbler mechanism 90 includes a tumbler housing 92 which extends through door 12 and contains a conventional key lock tumbler mechanism 94 as commonly known in the art. An electrical switch 96 is contained within tubular housing 16. Electrical switch 96 includes a valve stem 98, which is coplanar with the tubular housing 16 and extends substantially normally (i.e., horizontally) from longitudinal axis 40 of tubular housing 16. Valve stem 98 is designed for quick connection and disconnection with tumblers 94 so that modular electric door lock 10 may be easily attached to door 12 and operated from the exterior 100 of door 12 by means of a key 102. As is conventionally known in the art, key 102 is inserted into an aperture having a series of pins which intermesh with the toothed surface of key 102 so as to allow rotation thereof, thereby rotating valve stem 98 and actuating electrical switch 96.

Figure 5:
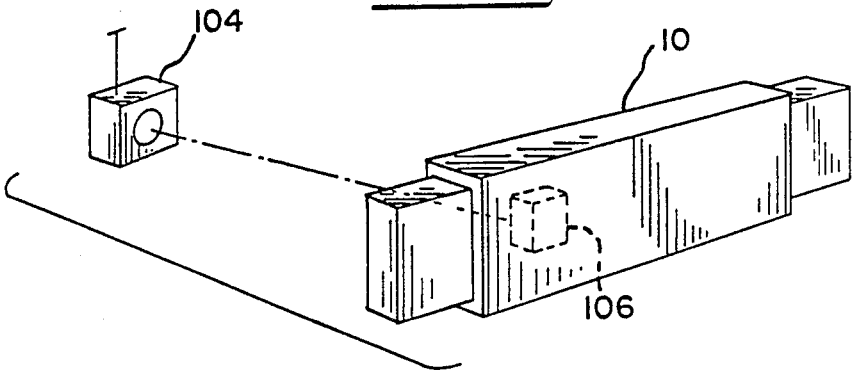
FIG. 5 of the drawings is a front perspective view of an alternate embodiment of the modular electric door lock of FIG. 1, showing in particular a remote switch and alarm mechanism for selectively actuating the electric door lock and for audibly indicating forcible entry of the door being protected.

Alternatively, a seen in FIG. 5 of the drawings, modular electric door lock 10 may be actuated by a remote switching member 104. In the embodiment shown, remote switching member 104 comprises a radio transmitter which is adapted to actuate a corresponding radio receiver 106 within tubular housing 16. Radio receiver 106 in turn actuates timer 70 so as to either lock or unlock door 12. Alternatively, remote switch 104 may comprise a simple electrical switch connected by means of conventional electric wires to timer 70 so as to allow entrance or exit from door 12 after actuation of remote switch 104.

In regard to timer 12, conventional numerical indicia such as liquid crystal displays, a light emitting diodes, or a circular clock may be utilized for indicating the time of day and the times set for opening and closing of the modular electric door lock. An adjustable alarm setting mechanism comprising the aforesaid, previously mentioned, switches 74, 76 and 80 are used for setting the desired times.

A key feature of the present invention is the light weight, easily transportable nature of tubular housing 16. By means of containing all the aforesaid components within a simple low cost housing, a security device may be easily and rapidly attached to a door or easily removed if desired. To this end, as seen in FIG. 6, tubular housing 16 may be attached to door 12 by means of a quick disconnect mechanism 108. In the embodiment shown, quick disconnect mechanism 108 includes a pair of brackets 110 and 112 which may easily be attached to appropriately shaped supporting member 114 fixedly attached to door 12. Alternatively, conventional lug bolts may be utilized for fixedly attaching tubular housing 16 to door 12. In use, valve stem 98 is inserted into tumbler housing 92 and brackets 110 and 112 are inserted into corresponding apertures 113 and 115 on support member 11. Modular electric door lock 10 may thus be utilized on a number of different doors, or replaced with a conventional wooden crossbar, as desired.

In regard to battery 68, in a preferred embodiment a simple nine volt battery is sufficient to actuate electric motors 42 and 44. This is possible due to the low current requirements of miniaturized direct current motors in the present state of the art such as those manufactured by MICROMO, INC. In addition, the relatively light weight high strength materials available today, such as fiberglass and metal aluminum alloys, reduce the weight required to be moved by electric motors 42 and 44. Further, alarm 88, timer 70, and electric motors 42 and 44 are transistorized so as to require a minimum of electrical current.

Figure 3:
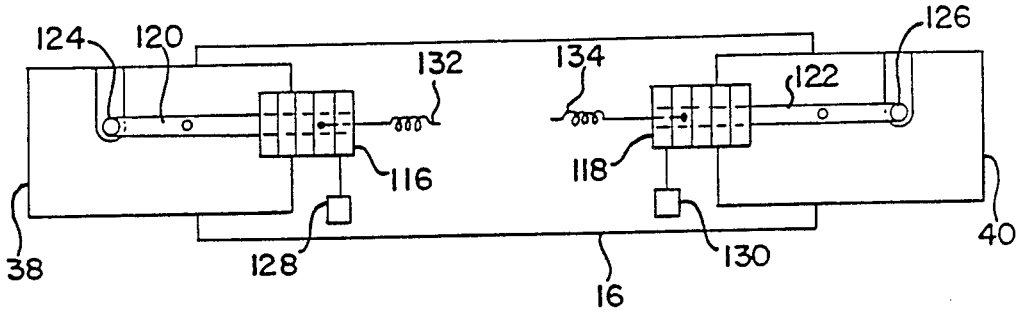
FIG. 3 of the drawings is a partial front cutaway view of an alternate embodiment of the modular electric door lock of FIG. 1, showing in particular the substitution of solenoids for the electric motor shown in FIG. 1.
Figure 4:
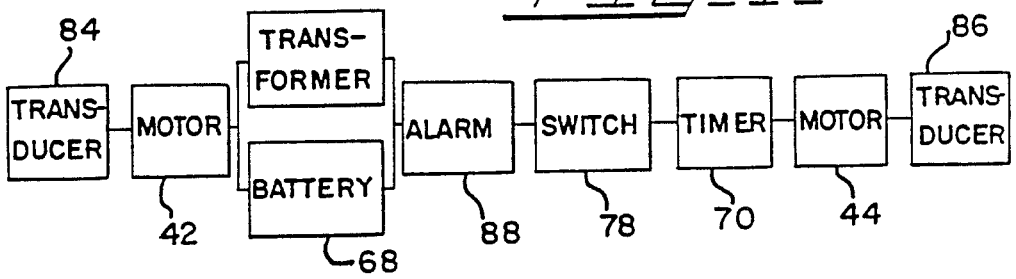
FIG. 4 of the drawings is a block diagram of the modular electric door lock of FIG. 1.

As best seen in FIG. 3, in an alternative embodiment of the invention, electrical motors 42 and 44 are replaced by solenoids 116 and 118, which have hinged arms 120 and 122 extending therefrom. Hinged arms 120 and 122 in turn are connected to pivots 124 and 126, which are pivotally attached to slides 38 and 40. Thus, when timer 70 actuates solenoids 116 and 118, slides 38 and 40 may be retracted into tubular housing 16 by means of arms 120 and 122. Once so retracted, slides 38 and 40 may be held in place by spring loaded pins 128 and 130. When spring loaded pins 128 and 130 are released, second spring mechanisms 132 and 134 may be utilized fo extending slides 38 and 40 into brackets 64 and 66. The remainder of the components described in FIG. 1 are utilized in the same manner in the modular electric lock of FIG. 3 with the exception of battery 68. Solenoids 115 and 116 require more current than a 9 volt battery. Thus either a larger battery or a source of AC current must be utilized, as described herein.

For example, as shown in FIG. 2, electrically connected to a battery member 68 is a transformer 138 having an extension cord 140 extending therefrom for electrical connection to a wall socket (not shown). Transformer 138 may be used to supply DC current to battery 68 or to provide AC current directly to timer 70, if so desired. In addition, transformer 138 may be used to recharge battery 68 so that in the event of a loss of electric power, modular electric door lock 10 continues to provide a secure lock of door 12.

The foregoing description and drawings merely explain and illustrate the invention and the invention is not so limited thereto except insofar as those who have the disclose before them are able to make modifications in variations therein without departing from the scope of the invention.

What is being claimed:

1. A modular electric door lock for securing a door having a left side and right opposite side, said door lock comprising:

a tubular housing member;

means for selectively affixing said tubular housing member to said door;

a pair of bracket members affixed to door support means proximate said opposite sides of said door and aligned with said tubular housing member;

a pair of oppositely disposed slide members contained within said housing member and including means for telescopic extension of said slide members from said housing into said brackets, and means for retraction of said slide members from said brackets back into said housing member;

said means for telescopic extension and retraction compromising electric motor means contained within said tubular housing and engaged with said slide members for selectively extending said slide members from said tubular housing into telescopic engagement with said bracket members and for retracting said slide members back into said housing member, as desired;

means for supplying an electrical motor means for selectively actuating said electric motor means; and switching means connected to said electric motor means for selectively actuating said electric motor means.

2. The modular electric door lock of claim 1 and further comprising:

transducer means for detecting movement of said door during attempted forcible entry through said door; and alarm means electrically connected to said transducer means for audibly indicating said attempt forcible entry.

3. The modular electric door lock of claim 1 and further comprising:

electric timer means electrically connected to said electric motor means for selectively actuating said electric motor means at preset times so as to lock or unlock said door as desired.

4. A modular electric door lock for securing a door having a left side and a right opposite side, said door lock comprising:

a tubular housing member;

means for selectively affixing said tubular housing member to said door;

a pair of bracket members affixed to door support means proximate said opposite sides of said door and aligned with said tubular housing member;

a pair of oppositely disposed slide members contained within said housing and including means for telescopic extension of said slide members from said housing into said brackets, and means for retraction of said slide members from said brackets back into said housing;

said means for telescopic extension and retraction comprising electric motor means contained within said tubular housing and engaged with said slide members for selectively extending said slide members from said tubular housing into telescopic engagement with said bracket members and for retracting said slide members back into said housing, as desired;

means for supplying an electrical current to said electric motor means switching means connected to said electric motor means for selectively actuating said electric motor means, tumbler means connected to said switching means and having an aperture constructed and arranged for reception of and interaction with a key member so that rotation of said key member in said aperture is effective to selectively actuate said switching means; and a tumbler housing affixed to the exterior of said door and extending therethrough to said tubular housing member; so as to allow locking and unlocking of said door from the exterior thereof when said key is rotated in said aperture.

5. The modular electric door lock of claim 1 wherein said switching means comprises:

a remote switch member including means for wireless transmission of an electrical signal;

a receiver electrically connected to said motor means for selective actuation thereof, so as to allow opening of said door from a remote location when signaled by said wireless remote switch member.

6. The modular electric door lock of claim 3 wherein said timer means comprises:

numerical indicia means comprising a clock for displaying the time of day and the times set for opening and closing of said modular electric door lock; and adjustable alarm setting means comprising one or more switches for setting the desired times for opening said modular electric door lock.

7. The modular electric door lock of claim 1 wherein said tubular housing comprises a lightweight easily transportable module having quick disconnect means extending therefrom for attachment to or detachment from said door, as desired.

8. The modular electric door lock of claim 1 wherein said means for supplying electrical current comprises a battery member contained within said housing member.

9. The modular electric door lock of claim 1 wherein said electric motor means comprises;

one or more miniaturized direct current motors gear means interposed between said slide members and said miniaturized direct current motor and engaged therewith so as to effect selectibe linear motion of said slide members upon actuation of said electric motor means; and battery means for supplying electrical current, to said electric motor.

10. A modular electric door lock for securing a door having a left side and a right opposite side, said door lock comprising:

a tubular housing member;

means for selectively affixing said tubular housing member to said door;

a pair of bracket members affixed to door support means proximate said opposite sides of said door and aligned with said housing member;

a pair of oppositely disposed slide members contained within said housing member and including means for telescopic extension of said slide members from said housing into said brackets, and means for retraction of said slide members from said brackets back into said housing member;

said means for telescopic extension and retraction comprising solenoid means contained within said tubular housing member and engaged with said slide members for selectively extending said slide members from said tubular housing member into telescopic engagement with said bracket members and for retracting said slide members back into said housing, as desired;

means for supplying an electrical current to said solenoid means; and switching means electrically connected to said electric motor means for selectively actuating said solenoid means.

11. The modular electric door lock of claim 10 and further comprising:

transducer means for detecting movement of said door during attempted forcible entry through said door; and alarm means electrically connected to said transducer means for audibly indicating said attempted forcible entry.

12. The modular electric door lock of claim 10 further comprising:

electric timer means electrically connected to said electric motor means for selectively actuating said electric motor means at preset times so as to lock or unlock said door as desired.

13. A modular electric door lock for securing a door having left side and right opposite side, said door lock comprising:

a tubular housing member;

means for selectively affixing said tubular housing member to said door;

a pair of bracket members affixed to door support means on said opposite sides of said door and aligned with said tubular housing member;

a pair of oppositely disposed slide members contained within said housing and including means for telescopic extension of said slide members from said housing into said brackets, and means for retraction of said slide members from said brackets back into said housing;

said means for telescopic extension and retraction comprising electric motor means contained within said tubular housing and engaged with said slide members for selectively extending said slide members from said tubular housing into telescopic engagement with said bracket members and for retracting said slide members back into said housing, as desired;

means for supplying an electrical current to said electric motor means;

switching means connected to said electric motor means for selectively actuating said electric motor means, tumbler means connected to said switching means and having a aperture constructed and arranged for reception of and interaction with a key member so that rotation of said key member in said aperture is effective to selectively actuate said switching means; and a tumbler housing affixed to the exterior of said door and extending therethrough to said tubular housing member; so as to allow locking and unlocking of said door from the exterior thereof when said key is rotated in said aperture.

14. The modular electric door lock of claim 10 wherein said switching means comprises:

a remote switch member including means for wireless transmission of of an electric signal; and a receiver electrically connected to said motor means for selective actuation thereof, so as to allow opening of said door from a remote location when signalled by said wireless remote switch member.

15. The modular electric door lock of claim 3 wherein said timer means comprises:

numerical indicia means comprising a clock for displaying the time of day and the times set for opening and closing of said modular electric door lock; and adjustable alarm setting means comprising one or more switches for setting the desired times for opening said modular electric door lock.

16. The modular electric door lock of claim 10 wherein said tubular housing is a lightweight, easily transportable module which includes quick disconnect means for attachment to or detachment from said door, as desired.

17. The modular electric door lock of claim 10 wherein said means for supplying electrical current comprises a battery member contained within said housing member.

18. The modular electric door lock as described in claim 7 wherein said quick disconnect means comprises one or more lengths of double sided adhesive tape.

19. The modular electric door lock of claim 7 wherein said quick disconnect means comprises a plurality of hooks adapted for attachment to one or more support members on said door.

20. The modular electric door lock of claim 6 wherein said alarm means includes a wireless remote signal device for indicating forced entry of said door at a location distant from said door so as to permit the summoning of police without alerting the intruder.

* * * * *